US009224376B1

(12) United States Patent
Feng

(10) Patent No.: US 9,224,376 B1
(45) Date of Patent: Dec. 29, 2015

(54) ELECTRIC VIOLIN

(71) Applicant: Shan Feng, Guangzhou (CN)

(72) Inventor: Shan Feng, Guangzhou (CN)

( * ) Notice: Subject to any disclaimer, the term of this patent is extended or adjusted under 35 U.S.C. 154(b) by 0 days.

(21) Appl. No.: 14/568,140

(22) Filed: Dec. 12, 2014

(30) Foreign Application Priority Data

Oct. 30, 2014 (CN) ..... 2014 1 0605822

(51) Int. Cl.
*G10H 1/32* (2006.01)
*G10H 5/00* (2006.01)
*G10H 1/18* (2006.01)

(52) U.S. Cl.
CPC ..... *G10H 1/18* (2013.01); *G10H 2220/365* (2013.01)

(58) Field of Classification Search
CPC ..... G10H 1/18; G10H 2220/096; G10H 2250/445; G10H 2220/365; G10H 2230/081; G10H 2230/075; G10F 1/18
USPC ..... 84/325, 718, 722, 740, 743
See application file for complete search history.

(56) References Cited

U.S. PATENT DOCUMENTS 4,177,705 A * 12/1979 Evangelista ..... 84/722
4,336,734 A * 6/1982 Polson ..... 84/646
4,372,187 A * 2/1983 Berg ..... 84/722
4,570,521 A * 2/1986 Fox ..... 84/653
4,580,479 A * 4/1986 Bonanno ..... 84/626
5,040,447 A * 8/1991 Murata et al. ..... 84/612
5,085,119 A * 2/1992 Cole ..... 84/724
5,117,730 A * 6/1992 Yamauchi ..... 84/723
5,166,466 A * 11/1992 Yamauchi ..... 84/690
5,200,568 A * 4/1993 Fukushima et al. ..... 84/658
5,286,916 A * 2/1994 Yamauchi ..... 84/661
5,396,025 A * 3/1995 Tamura ..... 84/736
5,398,585 A * 3/1995 Starr ..... 84/646
5,403,970 A * 4/1995 Aoki ..... 84/626
5,670,727 A * 9/1997 Xiao ..... 84/283
5,739,455 A * 4/1998 Poon ..... 84/615
6,111,179 A * 8/2000 Miller ..... 84/442
7,112,738 B2 * 9/2006 Hyakutake et al. ..... 84/737
7,521,619 B2 * 4/2009 Salter ..... 84/477 R
2011/0005367 A1 * 1/2011 Hwang et al. ..... 84/314 R
2011/0088535 A1 * 4/2011 Zarimis ..... 84/645
2011/0146477 A1 * 6/2011 Tsukamoto ..... 84/485 R
2011/0283868 A1 * 11/2011 Behringer et al. ..... 84/622
2012/0174736 A1 * 7/2012 Wang et al. ..... 84/622
2012/0272814 A1 * 11/2012 Menzies-Gow ..... 84/724

(Continued)

FOREIGN PATENT DOCUMENTS

CN 201917880 U 8/2011
CN 104091589 A 10/2014

*Primary Examiner* — Jeffrey Donels

(57) ABSTRACT

An electric violin comprises a head, a body and a bowstring module; the head is attached to the body via a connecting rod. The head includes a display screen and several string-buttons mounted at a side of the display screen. Each string-button is corresponding in position with one line of string-related instructions. The body includes a main CPU module, a data storage device, an audio circuit, a sound amplifier and a speaker therein. The body includes a control button and a bowstring-holding mechanism. The bowstring-holding mechanism includes a mounting groove in the body and a signal interface mounted in the bottom of the mounting groove. The bowstring module includes a base and a playing element; the playing element and the connection terminal are mounted on the base; the base is attached to the mounting groove by snap joint; and the connection terminal is connected with the signal interface.

9 Claims, 5 Drawing Sheets

(56) References Cited

U.S. PATENT DOCUMENTS

2012/0297962 A1* 11/2012 O'Donnell et al. ..... 84/645
2012/0318121 A1* 12/2012 Mittelstadt et al. ..... 84/743
2013/0174717 A1* 7/2013 Butera et al. ..... 84/609
2013/0180385 A1* 7/2013 Hamilton et al. ..... 84/603

* cited by examiner

ELECTRIC VIOLIN

CROSS-REFERENCE TO RELATED APPLICATIONS

This present application claims the benefit of Chinese Patent Application No. 201410605822.2 filed on Oct. 30, 2014, the contents of which are hereby incorporated by reference.

TECHNICAL FIELD

The present invention relates to an electric violin.

BACKGROUND

A Chinese patent application (CN201410312842.0) discloses a bowstring playing instructing apparatus, which is able to play music by imitating a real violin. However, the apparatus is actuated to make a sound by a touch screen, and thus it fails to imitate playing realistically. The said Chinese patent application should be improved.

SUMMARY OF THE INVENTION

To overcome the defects described above, the present invention provides an electric violin which is able to imitate playing realistically.

Some embodiments of the present invention refer to:

an electric violin, comprising:

a head, a body and a bowstring module; the head attached to the body via a connecting rod; wherein the head includes a display screen for displaying string-related instructions, and a plurality of string-buttons mounted at a side of the display screen, each string-button is corresponding in position with one line of the string-related instructions on the display screen;

the body includes a main CPU module, a data storage device, an audio circuit, a sound amplifier and a speaker therein; the body includes a control button and a bowstring-holding mechanism; the display screen, the string-buttons, the data storage device, the audio circuit and the sound amplifier are electrically connected with the main CPU module; the speaker is electrically connected with the sound amplifier; the bowstring-holding mechanism includes a mounting groove in the body and a signal interface mounted in the bottom of the mounting groove; the signal interface is electrically connected with the main CPU module;

the bowstring module includes a base, a playing element for generating playing signals and a connection terminal for transmitting the playing signals to the signal interface; the playing element and the connection terminal are mounted on the base; the base is attached to the mounting groove by snap joint; and the connection terminal is electrically connected with the signal interface.

Preferably, the playing element includes a driving gear, a rotating box, a rotating shaft, a pulling rod, a first grating gear, a first optical emitter, a first optical receiver, a second grating gear, a second optical emitter and a second optical receiver; the rotating box is coaxially and rotatablely attached to the driving gear via the rotating shaft; an end of the rotating shaft is mounted at the base; the second grating gear is positioned in the rotating box; the second optical emitter and the second optical receiver are respectively positioned at both sides of the second grating gear; a transmitting terminal of the second optical emitter is corresponding in position with a receiving terminal of the second optical receiver; the pulling rod has a rack on a side wall thereof; the pulling rod extends into the rotating box and can move along the length direction of the rotating box; the rack is configured for driving the second grating gear to rotate; the driving gear is configured for driving the first grating gear to rotate; the first optical emitter and the first optical receiver are respectively positioned at both sides of the first grating gear; a transmitting terminal of the first optical emitter is corresponding in position with a receiving terminal of the first optical receiver; and the first optical emitter, the first optical receiver, the second optical emitter, the second optical receiver are electronically connected with the connection terminal.

Preferably, the playing element includes a ball and an optical sensor for sensing the rotation of the ball; the base has a groove for holding the ball; and the optical sensor is electronically connected with the connection terminal.

Preferably, the playing element includes a rotating box, a rotating shaft, a pulling rod and an infrared generator, an image sensor and a processing chip; an end of the rotating shaft is fixed to the base; the rotating box is rotatablely mounted at the other end of the rotating shaft; the pulling rod extends into the rotating box and can move along the length direction of the rotating box; the infrared generator is configured for emitting an infrared on the rotating box and the pulling rod; The image sensor is configured for generating an image signal based on a reflected infrared from the rotating box and the pulling rod; and the processing chip is configured for transmitting the image signal to the main CPU module via the connection terminal and the signal interface.

Preferably, the playing element includes a camera mounted on the base; and the camera is electronically connected with the connection terminal.

Preferably, the head has a tremolo adjustment switch electronically connected with the main CPU module.

Preferably, the control button includes a power switch and volume adjustment buttons.

Preferably, the control button is a touch screen.

Preferably, an end of the connecting rod is fixed to the head, and the other end of the connecting rod is pivotally attached to the body.

Beneficial effects of the present invention are as follows: The present invention includes the said string-buttons and the said bowstring module, and thus can imitate a real violin more realistically and interestingly.

DETAILED DESCRIPTION OF THE PREFERRED EMBODIMENTS

Figure 1:
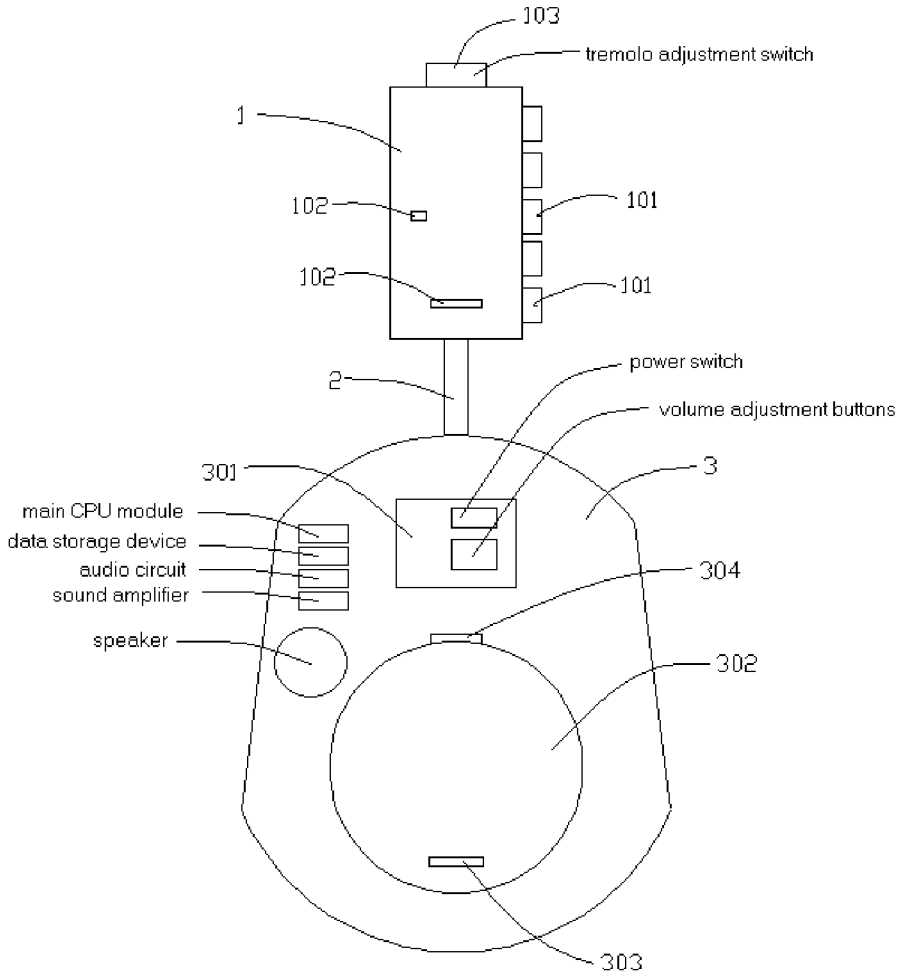
FIG. 1 is a schematic diagram of a head, a connecting rod and a body of a first embodiment of an electric violin.
Figure 2:
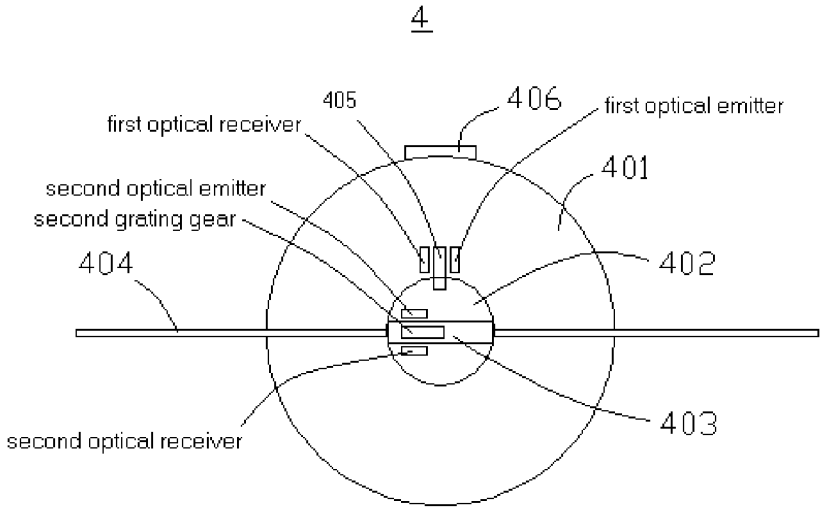
FIG. 2 is a schematic diagram of a bowstring module of the first embodiment of the electric violin.

FIG. 1 and FIG. 2 are schematic diagrams of a first embodiment of an electric violin. The electric violin includes a head, a body 3 and a bowstring module 4. The head is attached to the body 3 via a connecting rod 2.

The head includes a display screen 1 for displaying string-related instructions 102, and a plurality of string-buttons 101 mounted at a side of the display screen 1. Each string-button is corresponding in position with one line of the string-related instruction 102. In this embodiment, there are five string-buttons and five lines of the string-related instructions 102. In this embodiment, the string-related instruction is as the same as the one described in the Chinese patent application (CN 201410312842.0).

The body 3 includes a main CPU module, a data storage device, an audio circuit, a sound amplifier and a speaker therein. The body 3 includes a control button 301 and a bowstring-holding mechanism thereon. The display screen 1, the string-buttons 101, the data storage device, the audio circuit and the sound amplifier are electrically connected with the main CPU module. The speaker is electrically connected with the sound amplifier. The bowstring-holding mechanism includes a mounting groove 302 in the body 3 and a signal interface 303 mounted in the bottom of the mounting groove 302. The signal interface 303 is electrically connected with the main CPU module.

The bowstring module 4 includes a base 401, a playing element for generating playing signals and a connection terminal (not shown) for transmitting the playing signals to the signal interface 303. The playing element and the connection terminal are mounted on the base 401. The base 401 is attached to the mounting groove 302 by snap joint. For instance, the mounting groove 302 has a slot 304 at a side wall thereof. The base 401 has a locking part 406 at a side wall thereof. The locking part 406 is locked in the slot 304. The connection terminal is electrically connected with the signal interface 303.

Specifically, in this embodiment, the playing element includes a driving gear 402, a rotating box 403, a rotating shaft (not shown), a pulling rod 404, a first grating gear 405, a first optical emitter (not shown), a first optical receiver (not shown), a second grating gear 405, a second optical emitter (not shown) and a second optical receiver (not shown). The rotating box 403 is coaxially and rotatably attached to the driving gear 402 via the rotating shaft. An end of the rotating shaft is mounted at the base 401. The second grating gear is positioned in the rotating box. The second optical emitter and the second optical receiver are respectively positioned at both sides of the second grating gear. A transmitting terminal of the second optical emitter is corresponding in position with a receiving terminal of the second optical receiver, and thus the second optical receiver alternatively generates signal 0 and signal 1 when the second grating gear rotates. The signal 0 indicates that the second optical receiver does not receive an optical signal from the second optical emitter. The signal 1 indicates that the optical receiver receives the optical signal from the second optical emitter. The pulling rod 404 has a rack (not shown) on a side wall thereof. The pulling rod 404 extends into the rotating box 403 and can move along the length direction of the rotating box 403. The rack is configured for driving the second grating gear to rotate. The driving gear 402 is configured for driving the first grating gear to rotate. The first optical emitter and the first optical receiver are respectively positioned at both sides of the first grating gear 405. A transmitting terminal of the first optical emitter is corresponding in position with a receiving terminal of the first optical receiver. Thus the first optical receiver alternatively generates signal 0 and signal 1 when the first grating gear rotates. The first optical emitter, the first optical receiver, the second optical emitter, the second optical receiver are electronically connected with the connection terminal.

The head has a tremolo adjustment switch 103 electronically connected with the main CPU module.

In this embodiment, the control button 301 includes a power switch and volume adjustment buttons. The control button 301 can be a touch screen.

On account of the angle adjustment for meeting the playing requirement, an end of the connecting rod 2 is fixed to the head, and the other end of the connecting rod 2 is pivotally attached to the body 3.

In use, the user turns on the power of the violin by the control button 301, and selects a song to play. The main CPU module reads a corresponding MIDI (Musical Instrument Digital Interface) file from the data storage device, and then drives the speaker to play the song via the audio circuit and the sound amplifier. Simultaneously, the display screen displays the string-related instructions 102 described in the Chinese patent application (CN 201410312842.0). The user presses the corresponding string-buttons 101 according to the string-related instructions 102, and pulling the pulling rod 404 to rotate the rotating box 403, and thus the first optical receiver and the second optical receiver generate signals to imitate playing realistically. The main CPU module controls the speaker to correspondingly make sounds based on the signals from the string-button 101, the first and second optical receivers.

Figure 3:
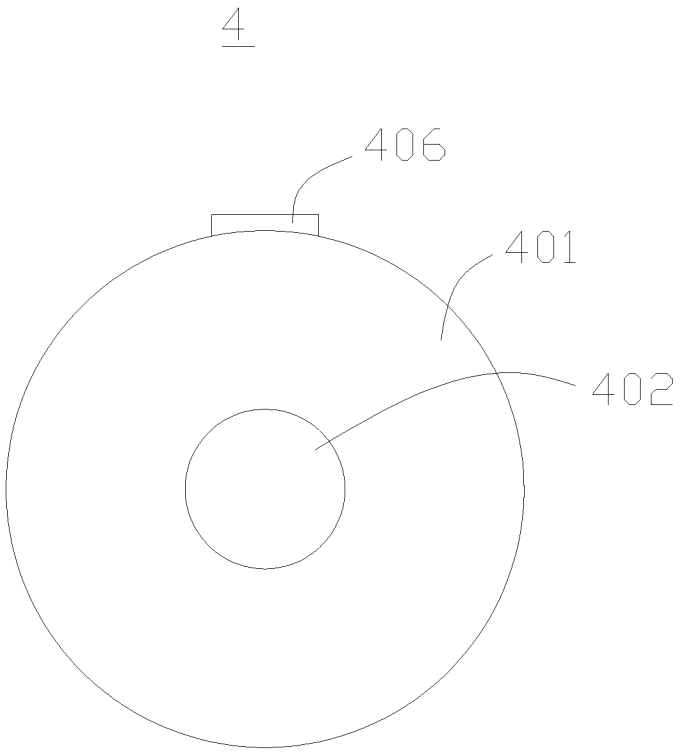
FIG. 3 is a schematic diagram of the bowstring module of the second embodiment of the electric violin.

In a second embodiment, as shown in FIG. 3, the playing element is different from the one in the first embodiment. In this embodiment, the playing element includes a ball 402 and an optical sensor (not shown) for sensing the rotation of the ball 402. The base 401 has a groove (not shown) for holding the ball 402. The optical sensor is electronically connected with the connection terminal. The base 401 has a locking part 406 locked in the slot 304. The assemble mechanism of the ball 402 and the optical sensor are described in the Chinese patent (CN 201020697403.3).

In use, the optical sensor generates signals according to the rotation of the ball 402. The main CPU module controls the speaker to make sounds based on the signals from the string-buttons and the optical sensor.

Figure 4:
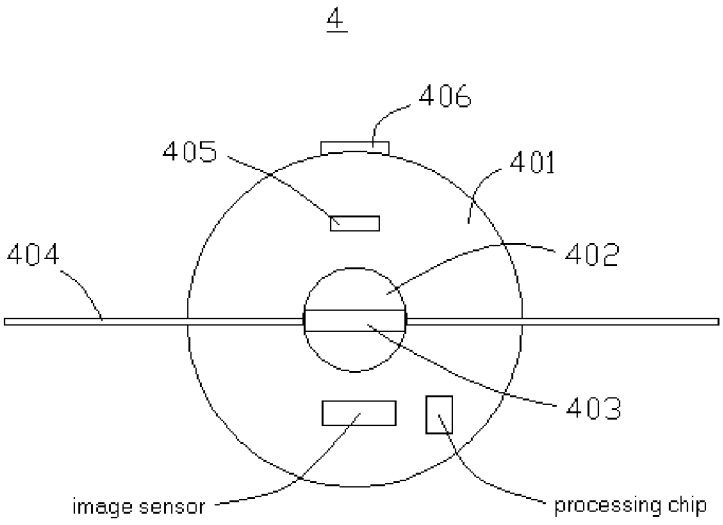
FIG. 4 is a schematic diagram of the bowstring module of the third embodiment of the electric violin.

In a third embodiment, as shown in FIG. 4, the playing element is different from the one in the first embodiment. In this embodiment, the playing element includes a rotating box 403, a rotating shaft, a pulling rod 404 and an infrared generator 405, an image sensor (not shown) and a processing chip (not shown). An end of the rotating shaft is fixed to the base 401. The rotating box 403 is rotatably mounted at the other end of the rotating shaft. The pulling rod 404 extends into the rotating box 403 and can move along the length direction of the rotating box 403. The infrared generator 405 is configured for emitting an infrared on the rotating box 403 and the pulling rod 404. The image sensor is configured for generating an image signal based on a reflected infrared from the rotating box 403 and the pulling rod 404. The processing chip is configured for transmitting the image signal to the main CPU module via the connection terminal and the signal interface 303. The base 401 has a locking part 406 locked in the slot 304.

In use, the user pulls the pulling rod 404 to drive the rotating box 403 to rotate. Thus the image sensor generates the image signal based on the movement of the pulling rod 404 and the rotating box 403. The main CPU module controls the speaker to make sounds based on signals from the string-buttons and the image sensor.

Figure 5:
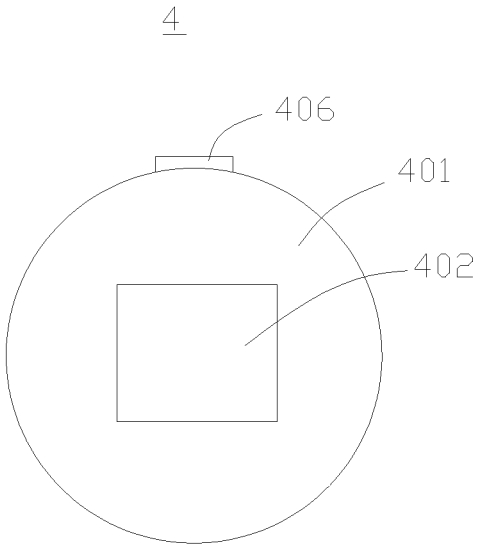
FIG. 5 is a schematic diagram of the bowstring module of the fourth embodiment of the electric violin.

In a fourth embodiment, as shown in FIG. 5, the playing element is different from the one in the first embodiment. In this embodiment, the playing element includes a camera 402 mounted on the base 401. The camera 402 is electronically connected with the connection terminal. In this embodiment, the camera 402 takes photos of gestures of the user. The main CPU module controls the speaker to make sounds based on the signals from the string-buttons and the camera.

The present invention includes the said bowstring module, and thus can imitate a real violin more realistically and interestingly.

Various modifications could be made to the embodiments by those of ordinary skill in the art without departing from the true spirit and scope of the disclosure. And those modified embodiments are covered by the claims of the disclosure.

What is claimed is:

1. An electric violin, comprising:

a head, a body and a bowstring module; the head attached to the body via a connecting rod; wherein the head includes a display screen for displaying string-related instructions, and a plurality of string-buttons mounted at a side of the display screen, each string-button is corresponding in position with one line of string-related instructions;

the body includes a main CPU module, a data storage device, an audio circuit, a sound amplifier and a speaker therein; the body includes a control button and a bowstring-holding mechanism thereon; the display screen, the string-buttons, the data storage device, the audio circuit and the sound amplifier are electrically connected with the main CPU module; the speaker is electrically connected with the sound amplifier; the bowstring-holding mechanism includes a mounting groove in the body and a signal interface mounted in the bottom of the mounting groove; the signal interface is electrically connected with the main CPU module;

the bowstring module includes a base, a playing element for generating playing signals and a connection terminal for transmitting the playing signals to the signal interface; the playing element and the connection terminal are mounted on the base; the base is attached to the mounting groove by snap joint; and the connection terminal is electrically connected with the signal interface.

2. The electric violin of claim 1, wherein the playing element includes a driving gear, a rotating box, a rotating shaft, a pulling rod, a first grating gear, a first optical emitter, a first optical receiver, a second grating gear, a second optical emitter and a second optical receiver; the rotating box is coaxially and rotatably attached to the driving gear via the rotating shaft; an end of the rotating shaft is mounted at the base; the second grating gear is positioned in the rotating box; the second optical emitter and the second optical receiver are respectively positioned at both sides of the second grating gear; a transmitting terminal of the second optical emitter is corresponding in position with a receiving terminal of the second optical receiver; the pulling rod has a rack on a side wall thereof; the pulling rod extends into the rotating box and can move along the length direction of the rotating box; the rack is configured for driving the second grating gear to rotate; the driving gear is configured for driving the first grating gear to rotate; the first optical emitter and the first optical receiver are respectively positioned at both sides of the first grating gear; a transmitting terminal of the first optical emitter is corresponding in position with a receiving terminal of the first optical receiver; and the first optical emitter, the first optical receiver, the second optical emitter, the second optical receiver are electronically connected with the connection terminal.

3. The electric violin of claim 1, wherein the playing element includes a ball and an optical sensor for sensing the rotation of the ball; the base has a groove for holding the ball; and the optical sensor is electronically connected with the connection terminal.

4. The electric violin of claim 1, wherein the playing element includes a rotating box, a rotating shaft, a pulling rod and an infrared generator, an image sensor and a processing chip; an end of the rotating shaft is fixed to the base; the rotating box is rotatably mounted at the other end of the rotating shaft; the pulling rod extends into the rotating box and can move along the length direction of the rotating box; the infrared generator is configured for emitting an infrared on the rotating box and the pulling rod; The image sensor is configured for generating an image signal based on a reflected infrared from the rotating box and the pulling rod; and the processing chip is configured for transmitting the image signal to the main CPU module via the connection terminal and the signal interface.

5. The electric violin of claim 1, wherein the playing element includes a camera mounted on the base; and the camera is electronically connected with the connection terminal.

6. The electric violin of claim 1, wherein the head has a tremolo adjustment switch electronically connected with the main CPU module.

7. The electric violin of claim 1, wherein the control button includes a power switch and volume adjustment buttons.

8. The electric violin of claim 1, wherein the control button is a touch screen.

9. The electric violin of claim 1, wherein an end of the connecting rod is fixed to the head, and the other end of the connecting rod is pivotally attached to the body.

* * * * *